US006068115A

United States Patent [19]

Boulton

[11] Patent Number: 6,068,115

[45] Date of Patent: May 30, 2000

[54] PACKAGE WITH ATTACHED LEAFLET

[75] Inventor: Ian T. Boulton, Cheshire, United Kingdom

[73] Assignee: Fibre Drums Limited, St. Helens, United Kingdom

[21] Appl. No.: 09/077,472

[22] PCT Filed: Nov. 29, 1996

[86] PCT No.: PCT/GB96/02963

§ 371 Date: Nov. 18, 1998

§ 102(e) Date: Nov. 18, 1998

[87] PCT Pub. No.: WO97/19860

PCT Pub. Date: Jun. 5, 1997

[30] Foreign Application Priority Data

Nov. 30, 1995 [GB] United Kingdom ..... 9524517
Feb. 15, 1996 [GB] United Kingdom ..... 9603161

[51] Int. Cl.[7] ..... B65D 69/00

[52] U.S. Cl. ..... 206/232; 206/45.29

[58] Field of Search ..... 206/232, 459.5, 206/45.28, 45.29, 494, 308.1, 768, 528, 534; 229/162; 150/138, 144, 145; 40/312

[56] References Cited

U.S. PATENT DOCUMENTS

| | | | |
|---|---|---|---|
| 2,296,556 | 9/1942 | Junkin . | |
| 3,483,909 | 12/1969 | Osher et al. | 150/145 |
| 3,755,925 | 9/1973 | Court | 206/232 |
| 5,232,087 | 8/1993 | Schluger . | |
| 5,293,994 | 3/1994 | Antik | 206/232 |
| 5,433,317 | 7/1995 | Roser . | |
| 5,484,054 | 1/1996 | Kryszewski | 206/232 |
| 5,497,876 | 3/1996 | Fleming | 206/232 |
| 5,738,221 | 4/1998 | Van Witt et al. | 206/308.1 |
| 5,775,490 | 7/1998 | Baker et al. | 206/308.1 |

FOREIGN PATENT DOCUMENTS

| | | |
|---|---|---|
| 295 15 811 U1 | 1/1996 | Germany . |
| 2 116 949 | 10/1983 | United Kingdom . |
| 2 277 077 | 10/1994 | United Kingdom . |
| 2 288 788 | 11/1995 | United Kingdom . |

*Primary Examiner*—M. D. Patterson
*Assistant Examiner*—Luan K. Bui
*Attorney, Agent, or Firm*—Brooks & Kushman P.C.

[57] ABSTRACT

A package is disclosed comprising a box having a closure flap 20 and an information sheet 18, the information sheet 18 being creased to permit it to be folded to lie flat against a face of the box, and the flap 29 being extended so that it can simultaneously cover the folded information sheet 18, and thereby retain it in position, and close the box.

20 Claims, 5 Drawing Sheets

PACKAGE WITH ATTACHED LEAFLET

The present invention relates to product packaging.

The packages in which products are presented to the public normally bear, on their outer surface, printed information—trade marks, advertising, warnings, instructions for use etc. While this can be an effective and economical way of displaying such information, it does suffer from certain disadvantages. In particular, the amount of information that can be displayed is limited by the surface area of the package, and may be inadequate if, for example, lengthy instructions or details of a product range are required.

The well known alternative method of presenting such data is to include a folded sheet or leaflet loose within the package. While this method can normally provide ample surface area for presenting the information, it too has some drawbacks. Most importantly, the leaflet is likely to be discarded or lost once the package has been opened. In addition, the leaflet must be inserted and appropriately arranged within the package during assembly thereof, which in itself requires an additional step in the packaging process.

A third known method is to attach a folded leaflet to the exterior of a package, but such leaflets are vulnerable to damage, prone to unfolding at inappropriate times and difficult to neatly re-fold, making the package awkward to handle.

A primary object of the present invention is to provide a package which makes possible presentation of a considerable amount of information without the above described problems associated with the prior art.

A box is known from U.S. Pat. No. 5,232,087 which is adapted to serve both as a greetings card and as a protective carrier for goods being sent by post. This box is formed from a single piece net of folded cardboard. The body of the box is cuboidal, having large rectangular front and rear faces, long left and right side faces and shorter top and bottom end faces. The left side face is initially open to allow insertion of goods, but can be closed by means of a tuck flap which meets the body of the box at a crease running along the lower left hand edge of the rear face. To enable the box to be used as a greetings card, it comprises a second flap the same shape as the front and rear faces which meets the body of the box at a crease running along the left hand edge of the front face. The second flap can be disposed against the front face, but can also be opened out in the manner of a greetings card. A protective cover for the box is formed by a third flap which meets the body of the box at a crease running along the right hand edge of the front face. When the box is to be sent by post, the third flap is folded so that it lies over the front face, sandwiching the second flap against the front face, and also lies over the left hand side face, a strip of adhesive tape ensuring that the third flap remains in this position, keeping the box closed.

While, in comparison with a conventional cardboard box, the second and third flaps provide an increased surface area for displaying printed information, their areas are determined by the dimensions of the box itself—eg. the size of the second flap cannot exceed the size of the upper face—so that this increase in surface area is limited.

In accordance with the present invention there is provided a package which comprises a box having a first face, a second face which intersects the first face and is penetrated by an opening, or is wholly open, for access to the interior of the box, and a flap, the package further comprising a leaflet formed separately from the box and cemented or otherwise attached to a face of the box, the leaflet being larger than the face of the box to which it is attached and being creased so that it can be folded to lie thereagainst, and the flap being creased and shaped such that it can be positioned to overlie both the first and second faces, thereby retaining the folded leaflet against the first face and closing the box.

The package thus formed can provide ample surface area for displaying information, with no risk that the information will be lost. Indeed, the leaflet is brought to the user's attention each time the package is opened, which is highly advantageous for advertising/instructional purposes.

Preferably, the leaflet is attached to the first face of the box, although it may alternatively be attached to a face of the box formed by an inner face of the flap.

In a particularly preferred embodiment, the leaflet is attached both to the first face and the inner face of the flap. In such an embodiment, the leaflet can be appropriately creased, eg. by star folding or cross folding, to automatically fold/unfold when the box is closed/opened.

The leaflet may, however, simply be concertina folded.

Cardboard or any similar sheet material are suitable for construction of the box. It is especially preferred that the flap and the remainder of the box are integrally formed from a single piece of such material.

In a particularly constructionally convenient embodiment of the present invention, the main part of the box is cuboidal, having a third face parallel to the first face and a fourth face parallel to the second face, and the flap meets the remainder of the box at a crease extending along the vertex where the third and fourth faces intersect, the flap being creased and shaped such that it can be positioned to overlie the first, second and fourth faces. Such a box can be formed from a single sheet of cardboard or similar sheet material bearing printing on only one of its faces, such that when the box is closed, all of its exterior faces bear printing.

The flap is preferably provided with a tab which can be inserted into the box to frictionally retain the flap in the closed position.

In the pharmaceutical industry, it is particularly important that the correct leaflet is attached to a given box, so that no (potentially dangerous) mis-matching of leaflet/box/contents occurs. Protection against such mis-matching can be provided by an embodiment of the present invention in which the flap is provided with a window through which, when the flap is used to close the box, the folded leaflet can be seen. Preferably, the leaflet bears identifying information which is visible through the window when the flap is used to close the box. Still more preferably the exterior of the box bears identifying information corresponding to the identifying information borne by the leaflet. The identifying information may be in machine readable form, to allow an automatic check to be made that the leaflet matches the box.

In accordance with a second aspect of the present invention, there is provided a package comprising a box, which comprises and is adapted to be closed by a flap, and a sheet bearing printed information, the sheet being attached to a first face of the box and being creased so that it can be folded to lie against the first face, and the flap being adapted to simultaneously close the box and substantially cover the folded sheet, thereby retaining the folded sheet against the first face.

Specific embodiments of the present invention will now be described, by way of example only, with reference to the accompanying Figures, wherein.

Figure 1:
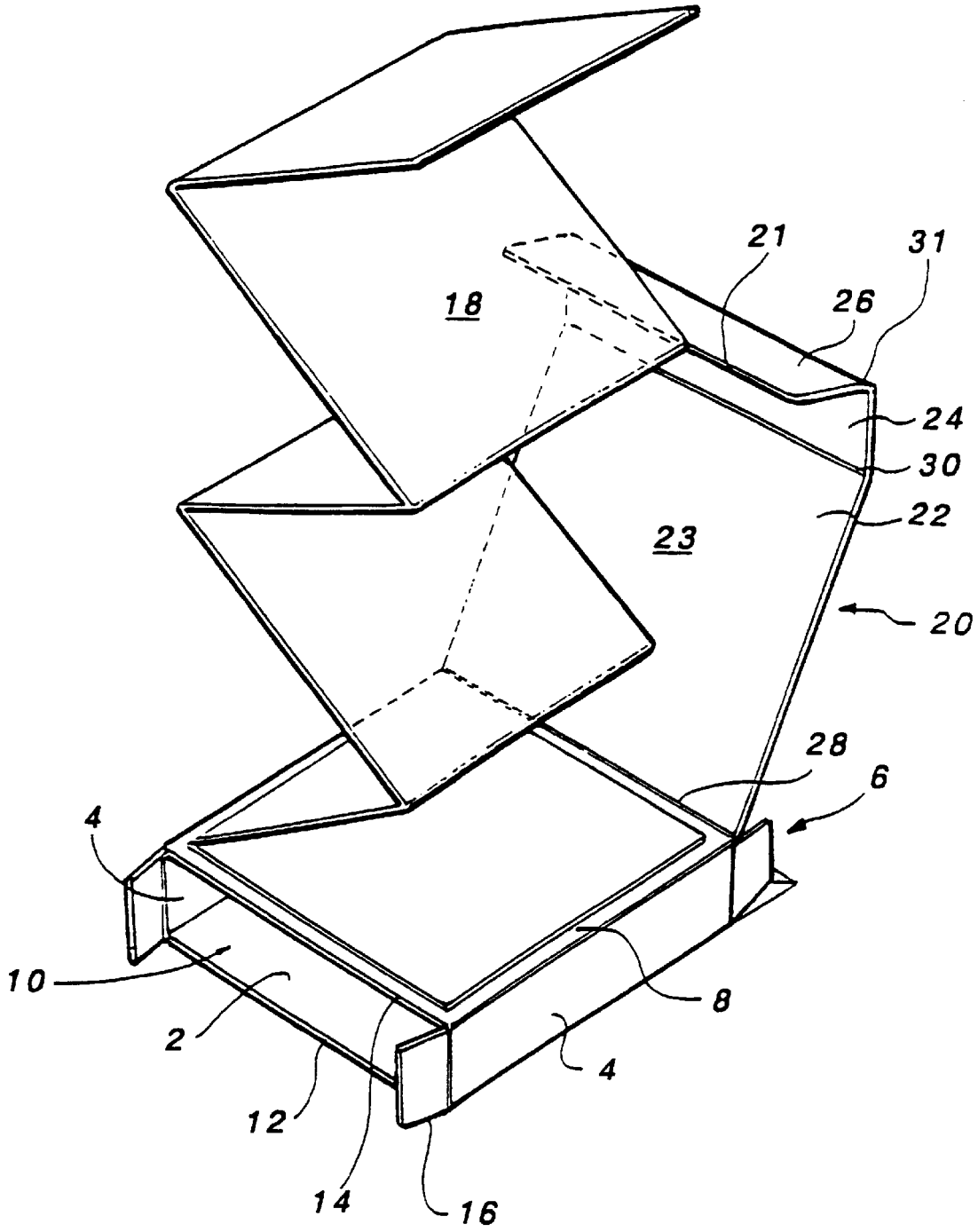
FIG. 1 is a perspective view of a first package constructed in accordance with the present invention.

The embodiment of the present invention illustrated in FIG. 1 comprises a cuboidal box formed, by known techniques, from folded cardboard or similar sheet material and having a square or rectangular base panel 2. The side and rear edges of the base panel 2 are joined via vertical, peripheral side and rear walls 4, 6 respectively to the corresponding edges of an upper panel 8, which is identical in shape to the base panel 2. The rear wall 6 is formed, in conventional manner, from three wall flaps, as the Figure shows. The interior of the box so formed is accessible via an aperture 10 defined by the front edges 12, 14 of the base panel 2 and the upper panel 8, along with front edges of the two side walls 4.

In conventional manner, two small flaps 16 extend from the front edges of the said two side walls 4.

The box is provided with a leaflet 18, shown partly unfolded. According to the present embodiment, the leaflet is "concertina" (or "fan") folded—that is, it consists of an elongate, rectangular strip of paper or cardboard folded back and forth to form a "stack" of paper/card several layers deep, the length and breadth of which is slightly smaller than the length and breadth of the upper panel 8. The bottom layer of this "stack" is cemented or otherwise attached to the upper panel 8.

Note that other fold patterns, including the known star fold and concertina and crossfold, could be used for the leaflet 18.

The box further comprises a main flap 20 adapted to cover and contain the leaflet 18, and to close the aperture 10. The main flap 20 is substantially rectangular, having a rear edge (seen at 28) and a front edge 21, and is creased to form three panels-a cover 22, a closure 24 and a retaining flap 26, as will now be described.

The cover 22 is substantially the same shape as the upper panel 8, and is attached along its rear edge to the rear edge of the upper panel 8 via a first crease 28 which acts as a hinge. The cover 22 can be folded down to a closed position in which it lies parallel to and just above the upper panel 8, the folded leaflet then being sandwiched between the cover and the upper panel and so being neatly stored and protected. When the cover 22 is lifted, as in the figure, the leaflet is revealed and can be unfolded and studied.

The front edge of the cover is formed by a second crease 30 in the main flap 20, forward of which is the closure 24. When the main flap 20 is in the closed position, the crease 30 lies parallel and adjacent to the front edge 14 of the upper panel 8, and the closure 24 can be folded down to cover the aperture 10 and so close the box.

At its front edge, the closure 24 meets, in a third crease 31, the retaining flap 26 which can be tucked into the box to retain the entire main flap 20 in the closed position. The retaining flap 26 then lies adjacent to the base panel 2 and is frictionally restrained by contact with the small flaps 16.

The box according to the present invention illustrated in FIG. 1 can be simply constructed from a single-piece cardboard net (the leaflet being additional).

The leaflet 18 is, in a further specific embodiment of the invention, not illustrated, be attached not to the upper panel 8, but to the face of the box formed by the inner face 23 of the cover part 22 of the main flap 20. In this case, the leaflet is still sandwiched against the upper panel 8 when the box is closed.

Indeed, the leaflet 18 may, as in a further specific embodiment, be attached both to the upper panel 8 and to the inner face 23. By using a suitable fold, such as a star fold or cross fold, the leaflet may then be arranged to open out automatically when the box is opened.

Figure 2:
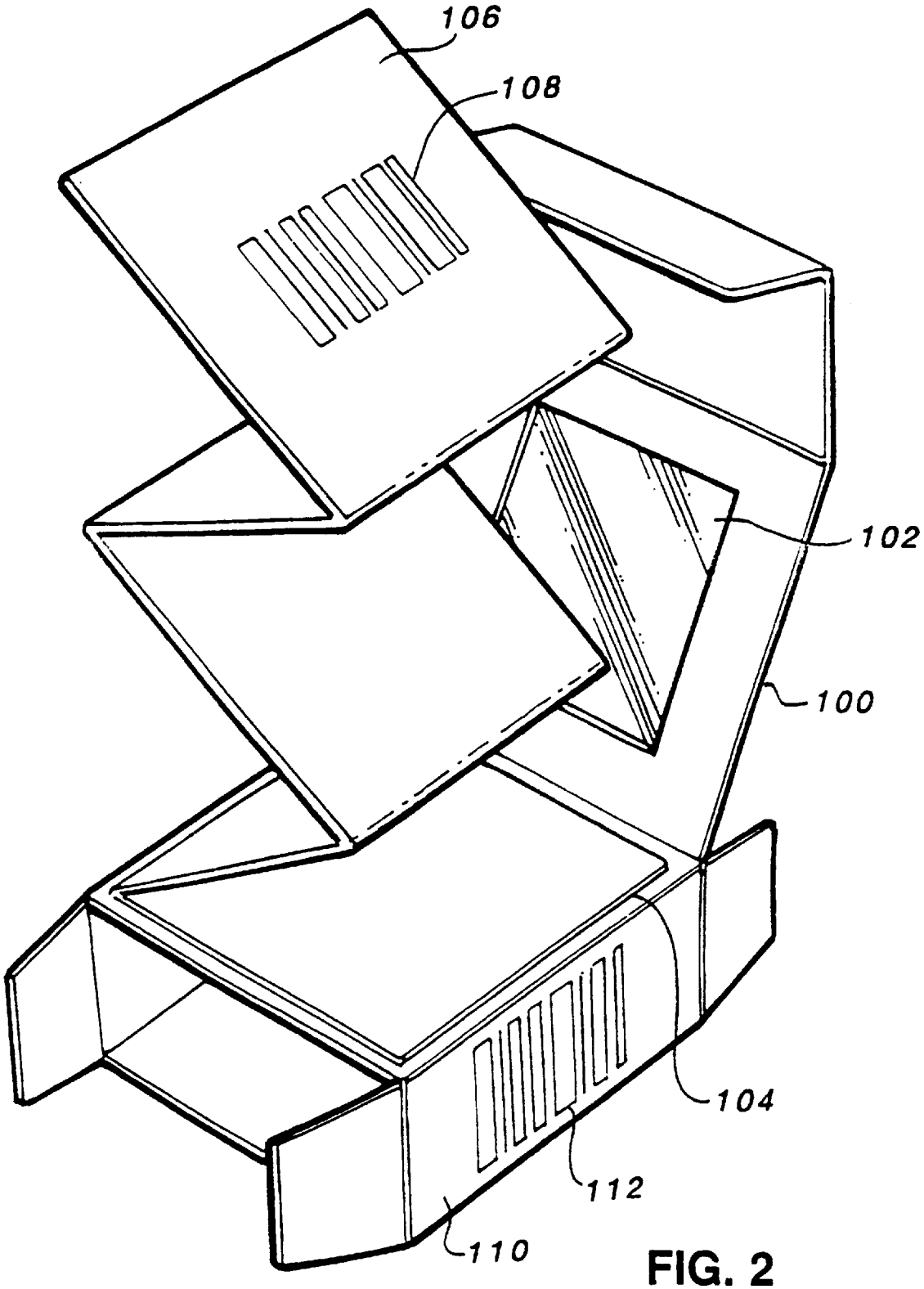
FIG. 2 is a perspective view of a second package, constructed in accordance with the present invention and comprising a transparent window.

The second package illustrated in FIG. 2 is similar to the package of FIG. 1 but includes, in the cover (which is labelled 100 in FIG. 2 but corresponds to cover 22 of FIG. 1) a window 102 through which (when the cover overlies the folded leaflet 104) the uppermost surface 106 of the folded leaflet can be seen.

The window 102 comprises an aperture in the cover 100. This aperture may be covered by a sheet of transparent material (eg plastics) or may simply be open.

Further, the uppermost surface 106 of the folded leaflet bears identifying information (in the illustrated embodiment this takes the form of a bar code 108). It is particularly advantageous for this information to be in machine readable form. A side 110 of the package bears identical or related identifying information (in the illustrated embodiment, a bar code 112).

This type of package allows for confirmation, at any stage of the packing process or subsequently, that the leaflet applied to the box correctly corresponds to the box itself and to its contents. It is therefore particularly well suited to use in the pharmaceutical industry, where any mistakes in the packing or labelling of drugs could have dangerous consequences and must therefore be prevented.

Figure 3:
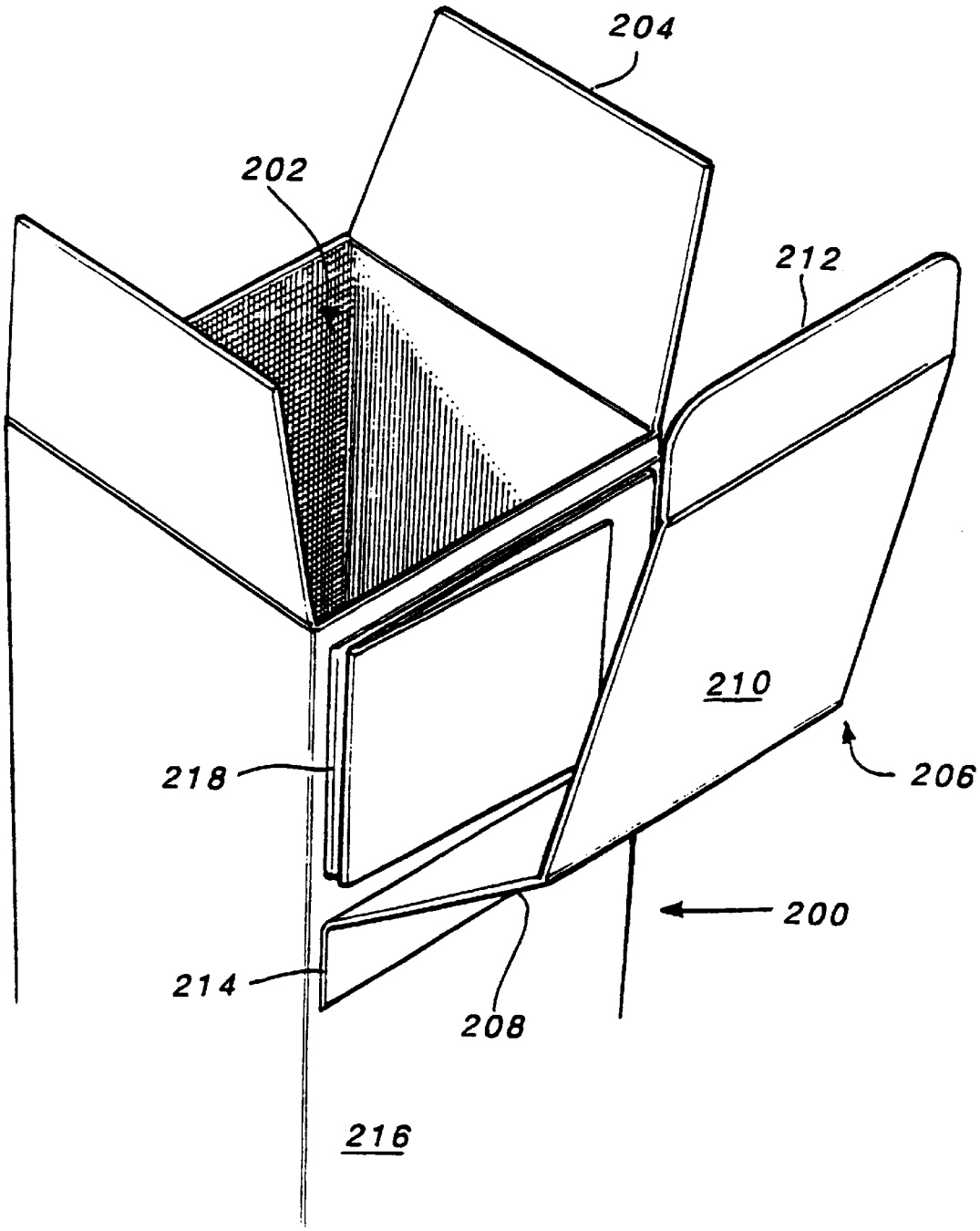
FIG. 3 is a perspective view of a third package constructed in accordance with the present invention.

FIG. 3 illustrates a package embodying the present invention and constructed rather differently from the packages of FIGS. 1 and 2. The type of construction in question is particularly well suited to long or tall packages, such as a box in which a bottle of whisky is presented.

As shown, the package comprises a box 200 of largely conventional construction. The illustrated box is cardboard, although other materials could be used. Access to the interior of the box is obtained through an aperture 202 at its upper face, and this aperture can be closed by tabs 204 and a main flap 206.

The main flap 206 differs from conventional flaps. Like the main flap of the two previously described embodiments, it is folded to provide a cover 208, a closure 210 and a retaining flap 212. In addition, the main flap 206 comprises an attachment tab 214 which meets the cover 208 in a further crease, at the edge of the cover remote from the closure 210.

The attachment tab 214 is joined by glue, cement, mechanical fasteners or other suitable means to one of the long side faces 216 of the box 200. A leaflet 218 is similarly joined to the same side face 216 at a location between the attachment tab 214 and the upper face of the box.

As for the previously described embodiments, the main flap 206 can be used to simultaneously cover and retain the leaflet 218 and close the box 200. When the box is opened, the leaflet is revealed.

Figure 4:
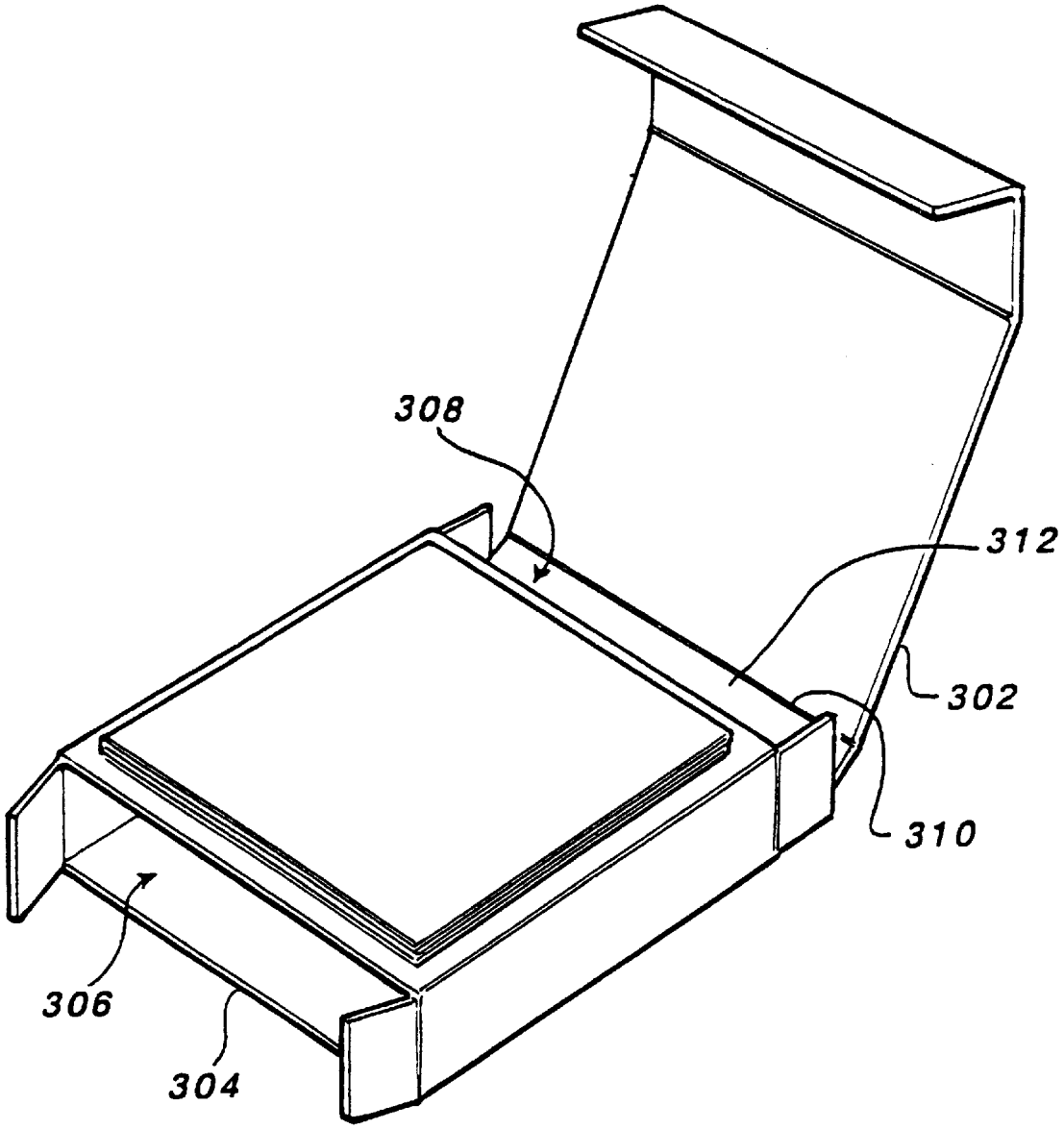
FIG. 4 is a perspective view of a fourth package constructed in accordance with the present invention.
Figure 5:
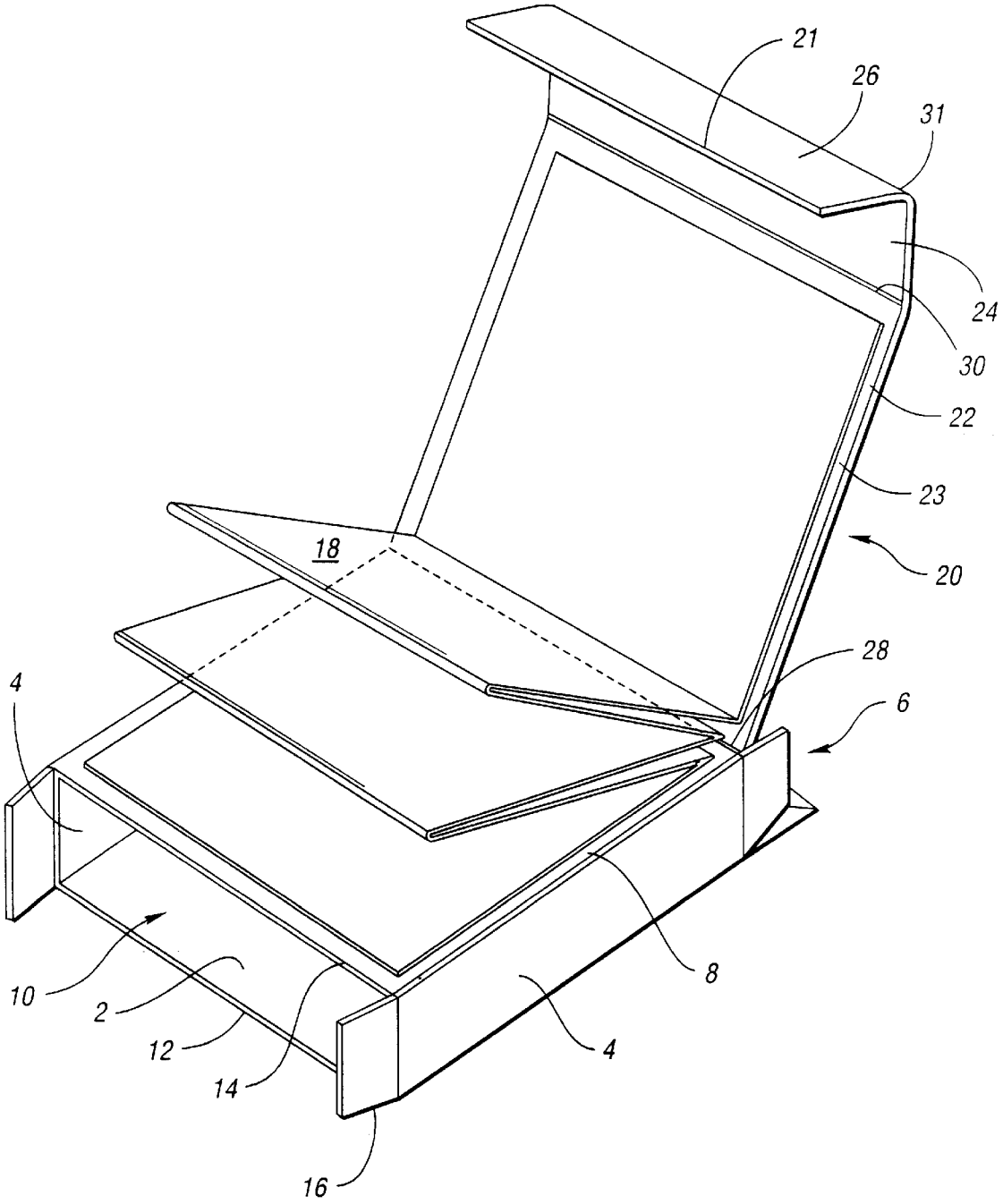
FIG. 5 is a perspective view of a fifth package constructed in accordance with the present invention.

Still another embodiment of the present invention is illustrated in FIG. 4. This package is similar to the one illustrated in FIG. 1, but differs therefrom in that whereas the main flap 20 of the FIG. 1 embodiment is attached by the crease 28 to the upper panel 8, the corresponding main flap 302 of the FIG. 4 embodiment is integrally formed with the base panel 304, meeting it at a crease which is not seen in FIG. 4. Thus, the main panel of this embodiment closes not only the front face 306 but also the rear face 308 of the box, and to this end comprises an additional fold 310 defining a fourth panel 312 of the main flap.

The advantage of this embodiment is that the box, including the main flap, can (as will be apparent) be formed from a single piece cardboard bearing printing on only one of its faces, such that in the closed state of the box, all of its outer faces show the printing.

What is claimed is:

1. A package comprising sheet material shaped and folded to form a cuboidal box body having a base panel coupled, by a pair of generally mutually parallel opposed side walls upstanding from said base panel, to an upper panel which is separated from and generally parallel to said base panel, said box body thus defining a cuboidal interior space for receiving product, said box body having first and second opposed apertures defined between said base and upper panels and said side walls, said package further comprising a flap formed from sheet material, a first crease being formed in said flap and so dividing said flap to form a cover flap-portion and a closure flap-portion, said cover flap-portion being coupled to said box body through a second crease, extending along a hinge line formed by the intersection of said cover flap-portion opposite to said first crease and one of said base panel and said upper panel, about which said flap is rotatable by a user between a closure position, in which said cover flap-portion lies adjacent and generally parallel to said upper panel and said closure flap-portion lies over and closes said first aperture of said box body, and an open position in which said flap is rotated away from said first aperture and said upper panel leaving said first aperture open for removal of product from said interior space by a user, said package further comprising a leaflet formed of sheet material, said leaflet being larger in an area than said cover flap-portion, being creased for folding into a compact configuration and being attached to at least one of said upper panel and said flap such that when said leaflet is in its compact configuration and said flap is in its closure position, said leaflet is sandwiched between said cover flap-portion and said upper panel and thereby retained against unfolding and such that when said flap is rotated to its open position said leaflet can be unfolded from its compact configuration enabling a user to study said leaflet.

2. A package as claimed in claim 1, where the leaflet is attached to both said upper panel and said cover flap-portion.

3. A package as claimed in claim 2, wherein the leaflet is creased such that it is automatically folded into its compact configuration when said flap is moved to its closure position and is automatically unfolded when said flap is moved to its open position to enable a user to study the leaflet.

4. A package as claimed in claim 1, wherein the leaflet is creased such that it can be concertina folded.

5. A package as claimed in claim 1, wherein the box body and the flap comprise cardboard.

6. A package as claimed in claim 5, wherein the flap and the box body are integrally formed from a single piece of cardboard.

7. A package as claimed in claim 6, wherein the second crease extends along the hinge line formed by the intersection of the upper panel and the cover-flap portion.

8. A package as claimed in claim 7, wherein the second crease coupling said cover flap-portion to the box body extends along a hinge line of the box body formed between the base panel and the cover-flap portion, the flap being creased and shaped such that in its closure position it lies over both of the apertures and the upper panel.

9. A package as claimed in claim 8, wherein the single piece of cardboard from which the flap and the box body are formed bears printing on only one of its faces.

10. A package as claimed in claim 1, wherein the flap comprises a tab which can be inserted into the box to frictionally retain the flap in its closed position.

11. A package as claimed in claim 1, wherein the flap is provided with a window through which, when the flap is in its closure position, the folded leaflet can be seen.

12. package as claimed in claim 11, wherein the leaflet bears identifying information which is visible through said window when the flap is used to close the box.

13. A package as claimed in claim 12, wherein the box body has an exterior bearing identifying information corresponding to said identifying information borne by said leaflet.

14. A package as claimed in claim 13, wherein the identifying information is in machine readable form.

15. A package which comprises a box having a first face, a second face which intersects said first face and is openable for access to the interior of the box, and a flap, said package further comprising a leaflet formed separately from the box and attached to one of the first face and the flap, the leaflet being larger than the first face of the box and being creased so that it can be folded to lie thereagainst, and the flap being creased and shaped such that it can be disposed in either of a closed configuration, in which the flap overlies the first face, thereby retaining the folded leaflet against the first face, and also closes the second face to close the box, and an open configuration, in which the flap is rotated away from the first and second faces such that the second face is open and the leaflet is exposed and can be unfolded.

16. A package as claimed in claim 15, wherein the leaflet is creased such that it is automatically folded when the flap is moved to its closed configuration and unfolded when the flap is moved to its open configuration.

17. A package as claimed in claim 15, wherein the flap and the box are integrally formed from a single piece of cardboard.

18. A package as claimed in claim 17, wherein the flap meets the box at a crease extending along an edge of the first face of the box remote from the second face of the box.

19. A package as claimed in claim 15, wherein the flap is provided with a window through which, when the flap is in its closed configuration, the folded leaflet can be seen.

20. A package as claimed in claim 19, wherein the leaflet bears identifying information which is visible through the window when the flap is in its closed configuration.

* * * * *